US007100663B2

(12) United States Patent
Zhang et al.

(10) Patent No.: US 7,100,663 B2
(45) Date of Patent: Sep. 5, 2006

(54) WINDOW COVERING AND METHOD OF USE

(75) Inventors: Yihong Zhang, Madison, WI (US); Toralf H. Strand, Madison, WI (US); John E. Morris, Lake Mills, WI (US)

(73) Assignee: Springs Window Fashions LP, Fort Mill, SC (US)

( * ) Notice: Subject to any disclaimer, the term of this patent is extended or adjusted under 35 U.S.C. 154(b) by 0 days.

(21) Appl. No.: 10/652,179

(22) Filed: Aug. 29, 2003

(65) Prior Publication Data

US 2005/0045279 A1 Mar. 3, 2005

(51) Int. Cl.
*E06B 9/08* (2006.01)

(52) U.S. Cl. ..... 160/89; 160/121.1

(58) Field of Classification Search ..... 160/89, 160/121.1, 84.05, 84.04, 115, 84.03, 405, 160/84.01, 172 R, 176.1 R, 178.3 R, 121, 160/172.1 R See application file for complete search history.

(56) References Cited

U.S. PATENT DOCUMENTS 2,227,238 A * 12/1940 Harlow ..... 160/89
2,434,786 A 1/1948 Browning
2,914,122 A * 11/1959 Salvatore ..... 160/89
2,994,370 A * 8/1961 Salvatore ..... 160/89
4,006,770 A * 2/1977 Ferguson ..... 160/263
4,187,897 A 2/1980 Frentzel
4,194,550 A * 3/1980 Hopper ..... 160/121.1
4,224,973 A * 9/1980 Hugin ..... 160/178.1 V
4,621,673 A 11/1986 Georgopoulos et al.
4,724,885 A * 2/1988 Chang ..... 160/89
4,842,034 A * 6/1989 Haines ..... 160/84.04
4,953,610 A 9/1990 Phillips et al.
4,984,617 A * 1/1991 Corey ..... 160/84.02
5,121,783 A * 6/1992 Nilsson ..... 160/89
5,205,334 A 4/1993 Judkins
RE34,273 E 6/1993 Phillips et al.
5,287,908 A 2/1994 Hoffmann et al.
5,313,999 A 5/1994 Colson et al.
5,320,154 A 6/1994 Colson et al.
5,339,882 A 8/1994 Judkins
5,392,832 A 2/1995 Colson et al.
5,394,922 A 3/1995 Colson et al.
5,419,385 A * 5/1995 Vogel et al. ..... 160/121.1
5,456,304 A 10/1995 Colson et al.
5,490,553 A * 2/1996 Colson et al. ..... 160/84.06
5,573,051 A 11/1996 Judkins
5,601,129 A 2/1997 Colson et al.
5,620,035 A 4/1997 Judkins
5,647,421 A 7/1997 Hoffmann et al.
5,664,613 A * 9/1997 Jelic ..... 160/84.05
5,692,552 A 12/1997 Judkins
5,699,845 A 12/1997 Jelic
5,706,876 A * 1/1998 Lysyj ..... 160/84.05
5,713,407 A 2/1998 Judkins
5,718,799 A 2/1998 Colson et al.
5,787,951 A 8/1998 Tonomura et al.

(Continued)

*Primary Examiner*—David Purol
(74) *Attorney, Agent, or Firm*—Lerner, David, Littenberg, Krumholz & Mentlik, LLP

(57) ABSTRACT

A window covering including two sheets of material extending from a take-up member and having a plurality of substantially horizontal slats disposed between the sheets of material is described. The horizontal slats can be adjusted between open and closed positions when the window covering is in a plurality vertical positions. In certain embodiments, the horizontal slats can be positioned independently from the movement of the sheets of material.

46 Claims, 11 Drawing Sheets

U.S. PATENT DOCUMENTS 5,806,579 A 9/1998 Judkins
5,826,638 A 10/1998 Jelic
5,839,494 A 11/1998 Judkins
5,855,235 A 1/1999 Colson et al.
5,918,655 A 7/1999 Corey
6,001,199 A 12/1999 Colson et al.
6,024,819 A 2/2000 Corey et al.
6,033,504 A 3/2000 Judkins
6,068,039 A 5/2000 Judkins
6,070,639 A 6/2000 Winston et al.
6,105,655 A 8/2000 Judkins
6,112,797 A 9/2000 Colson et al.
6,123,137 A 9/2000 Levert
6,164,363 A 12/2000 Colson et al.
6,196,291 B1 3/2001 Rupel et al.
6,263,944 B1 7/2001 Judkins
6,302,982 B1 10/2001 Corey et al.
6,354,353 B1 3/2002 Green et al.
D456,196 S 4/2002 Silver
6,377,384 B1 4/2002 Corey et al.
6,397,917 B1 6/2002 Levert
6,425,432 B1 7/2002 Gross et al.
6,431,246 B1 8/2002 Peterson
6,484,786 B1 * 11/2002 Ruggles et al. ..... 160/84.05
6,516,856 B1 * 2/2003 Lai ..... 160/89
6,561,252 B1 5/2003 Anderson et al.
6,575,222 B1 6/2003 Corey et al.
6,675,859 B1 * 1/2004 Nien ..... 160/89
6,688,369 B1 * 2/2004 Colson et al. ..... 160/121.1
6,745,811 B1 * 6/2004 Nien ..... 160/121.1
6,752,194 B1 * 6/2004 Huang ..... 160/168.1 R
6,772,815 B1 * 8/2004 Judkins ..... 160/84.05
6,796,360 B1 * 9/2004 Ferrie et al. ..... 160/172 R
2001/0037864 A1 11/2001 Colson et al.
2002/0007923 A1 1/2002 Colson et al.
2002/0038694 A1 4/2002 Levert
2003/0029577 A1 2/2003 Palmer et al.
2003/0051823 A1 3/2003 Nien
2003/0062136 A1 4/2003 Nien

* cited by examiner

WINDOW COVERING AND METHOD OF USE

FIELD OF THE INVENTION

This invention relates to a window covering and a method of using a window covering. More particularly, the invention relates to a window covering having sheets of material sandwiching a blind assembly.

BACKGROUND OF THE INVENTION

The past several decades have been marked by tremendous growth in the types of window covering materials that are available to purchasers. These types of window coverings include slatted horizontal blinds and fabric window coverings such as roller shades. Among the many choices of fabric window coverings, there are shade materials which are transparent to some degree or sheer, as well as shade materials which are much more opaque, keeping out a much greater degree of light and providing a greater degree of privacy than is offered by shade materials that are substantially transparent or sheer.

Many consumers prefer fabric window coverings made from sheets of material. Such window coverings have a softer and more uniform appearance than Venetian blinds. However, Venetian blinds have several advantages as well. One of the main features preferred by users of Venetian blinds is the ability to control the amount of light admitted through the blind. When the blinds are tilted so that the slats are in a closed position, little or no light is admitted through the blind. When the slats of the blind are tilted in a substantially horizontal or open position, a maximum amount of light is admitted through the blind.

Because Venetian blinds and fabric window coverings each have their own advantages, products have been offered that combine the features of both products. Typically these products are manufactured by fastening two sheets of sheer material to horizontally extending vanes or slats that connect the sheets of material. One limitation of these products is that such products are difficult to manufacture. Another limitation of these products is that the vanes or slats cannot be controlled independently from raising and lowering the sheets of material. In addition, the slats or vanes often cannot be adjusted when the window covering is in an intermediate position.

It would be desirable to provide a window covering including sheets of material and horizontal slats disposed between the sheets of material that is easier to manufacture than presently available products. It would also be desirable to provide a window covering in which the horizontal slats could be adjusted when the window covering is located at a plurality of vertical positions.

SUMMARY

According to one or more embodiments of the invention a window covering is provided. The window covering comprises two vertically extending sheets of material having a plurality of horizontally extending and vertically spaced slats disposed therebetween and a rotatable, substantially tube-shaped take-up member attached to one end of the sheets of material, the take-up member configured to raise and lower the sheets of material. According to these embodiments, a tilt mechanism is provided for the horizontal slats, and the tilt mechanism is configured to tilt the slats when the window covering is in any of a plurality of vertical positions.

In preferred embodiments, the window covering further includes a horizontally extending bottom rail, and the sheets of material are attached to the bottom rail. According to certain embodiments, the sheets of material include sheer material. The window covering preferably further comprises a mount configured to secure the take-up member adjacent a window opening. According to certain embodiments, the mount includes a pair of brackets configured to connect to end portions of the take-up member. In other embodiments, the mount comprises a headrail to which the take-up member is mounted.

In certain preferred embodiments, the window covering further comprises a horizontally extending intermediate rail disposed between the bottom rail and the take-up member.

The window covering according to certain embodiments further comprises a ladder including two vertically orientated cords extending between the intermediate rail and the bottom rail, and rungs extending between the ladder cords to support slats of the blind. In some embodiments, a guide cord is provided which runs in a substantially vertical direction between the intermediate rail and the bottom rail and through a hole or notch in each of the slats. In certain embodiments including a guide cord, the window covering may further comprise a cord take-up mechanism associated with the window covering for taking up the guide cord. The guide cord take-up mechanism may be associated with the bottom rail, head rail or intermediate rail. Preferably, the guide cord take-up mechanism includes a spring motor. In preferred embodiments, the window covering has a pair of guide cords running in a substantially vertical direction between the intermediate rail and the bottom rail and through holes or notches in each of the slats, and a pair of cord take up mechanisms associated with the bottom rail for taking up each of the guide cords.

In accordance with one or more embodiments, the window covering includes a tilt mechanism for the slats. The tilt mechanism may include a tilt drum associated with the intermediate rail and an axially extending tilt shaft in communication with the tilt drum, the tilt shaft configured such that rotation of shaft rotates the drum, causing one of the ladder cords to be raised and the other ladder cord to be lowered from a neutral position. In other embodiments, the tilt mechanism comprises a tilt cord attached to a front portion and a rear portion of the intermediate rail and straddling an upper portion of the tube. In certain embodiments that utilize a tilt cord, the tilt cord is operative to tilt the slats in a first direction when the sheets of material are raised and wrapped around the take-up member and tilt the slats in a second direction opposite to the first direction when the sheets of material are lowered and unwrapped from around the take-up member. A slot on the take up member for frictionally engaging the cord on the take-up member may be provided for facilitating tilting of the slats.

Lowering and raising of the window covering may be accomplished using conventional means for raising and lowering fabric window coverings and roller blinds. For example, the window covering assembly may include a clutch mechanism associated with the sheet take-up member for rotating the take-up member to raise or lower the sheets of material. Raising and lowering the sheets of material may also raise and lower at least a portion of the horizontal slats.

Other embodiments of the invention relate to a window covering comprising two vertically extending sheets of material having a plurality of horizontally extending and vertically spaced slats disposed therebetween and a rotatable, substantially tube-shaped take-up member attached to one end of the sheets of material, the take-up member configured to raise and lower the sheets of material. According to these embodiments, a bottom rail is attached to the lower end of each of the sheets of material opposite the end attached to the take-up member, wherein the horizontally extending slats can be tilted independently of the sheets of material.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENTS

Figure 1:
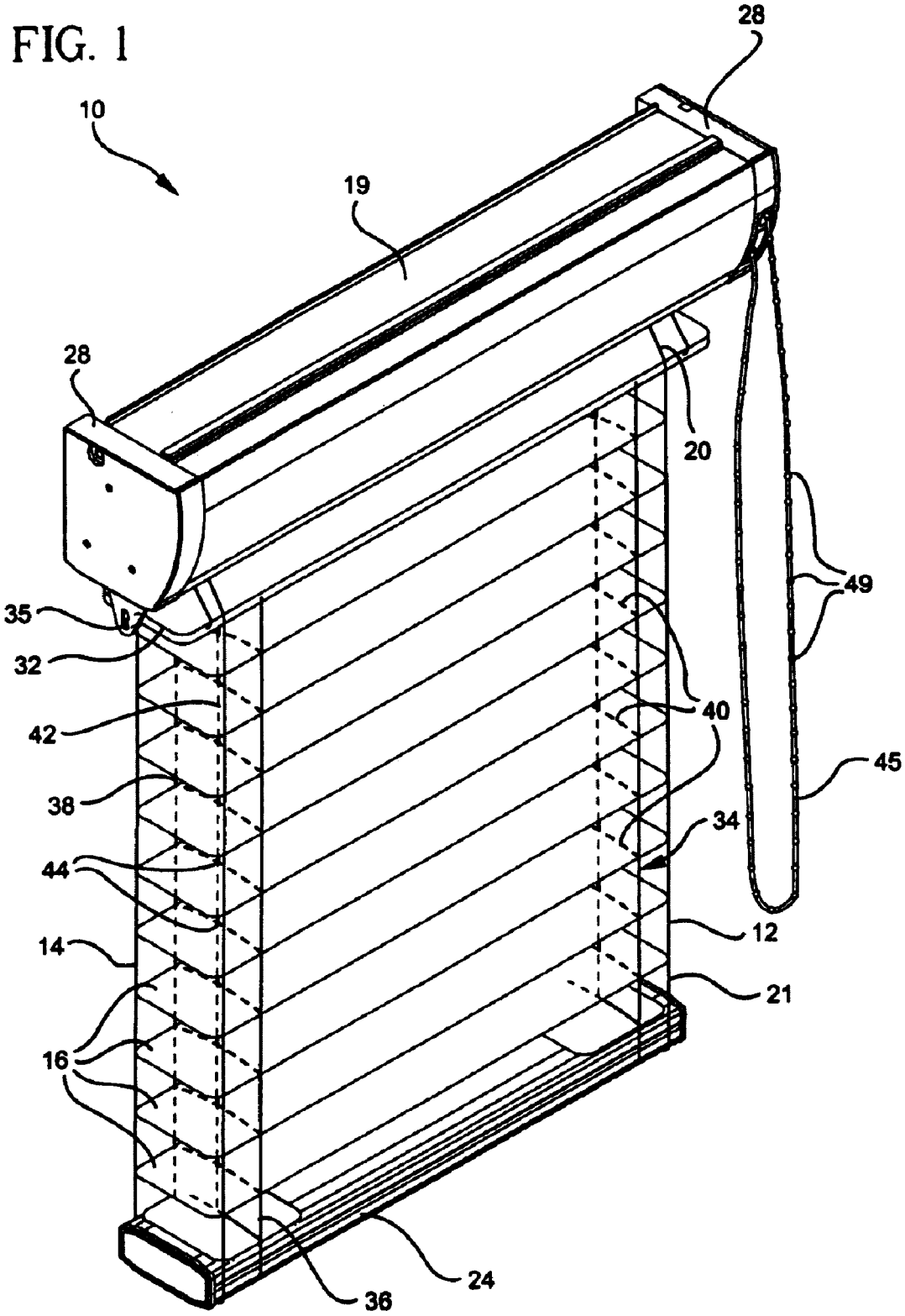
FIG. 1 is a perspective view of a window covering according to one embodiment of the present invention.
Figure 2:
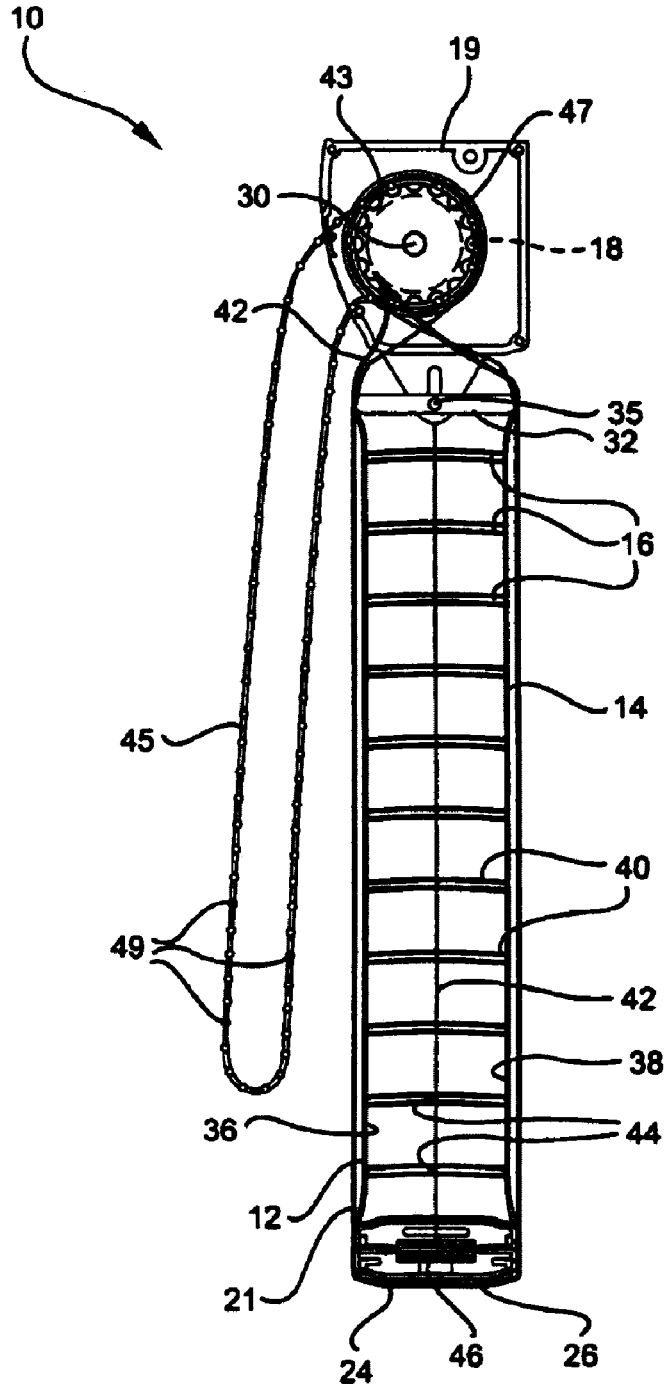
FIG. 2 is a side view of the window covering shown in FIG. 1.
Figure 3:
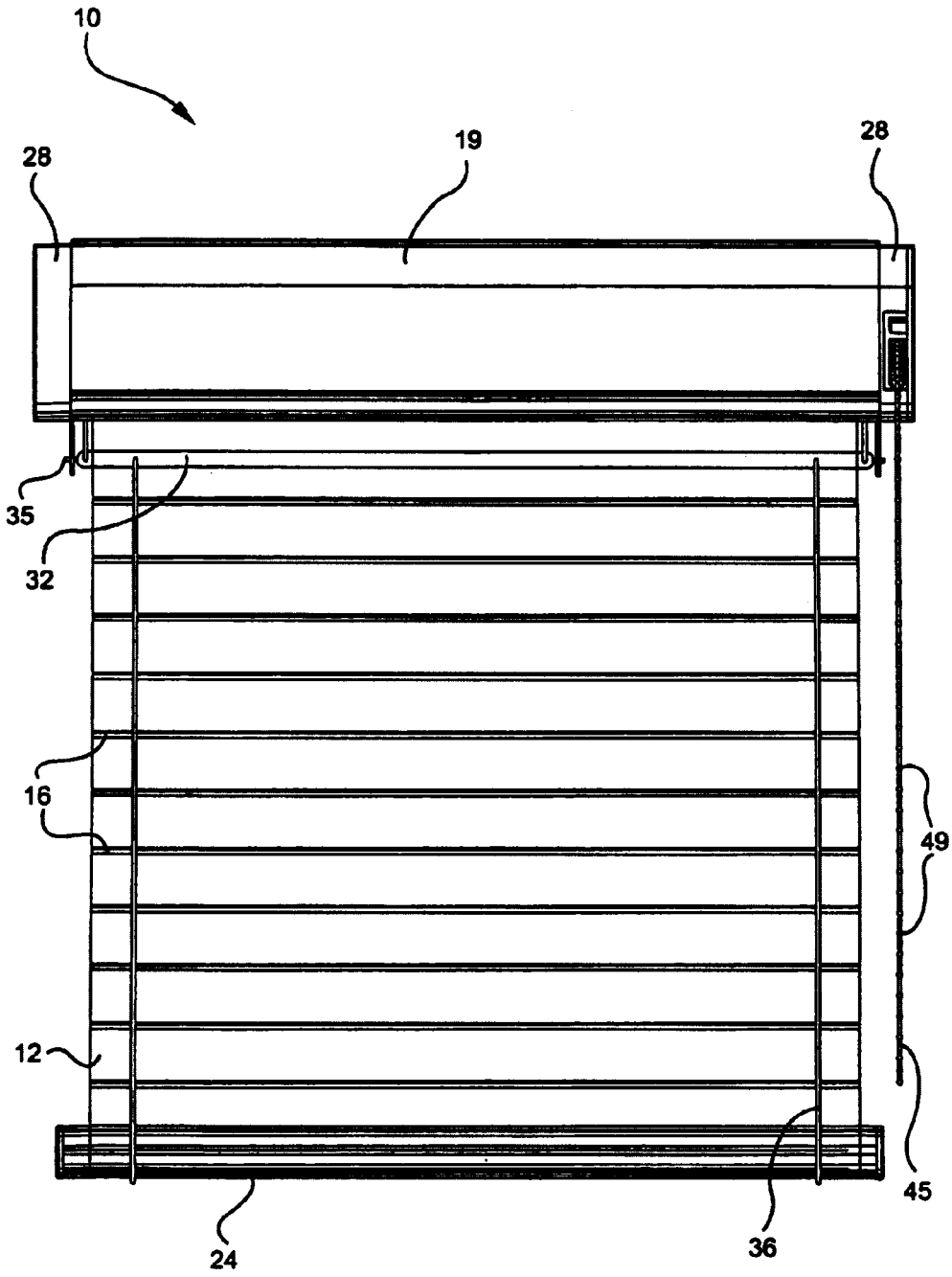
FIG. 3 is front view of the window covering shown in FIG. 1.
Figure 4:
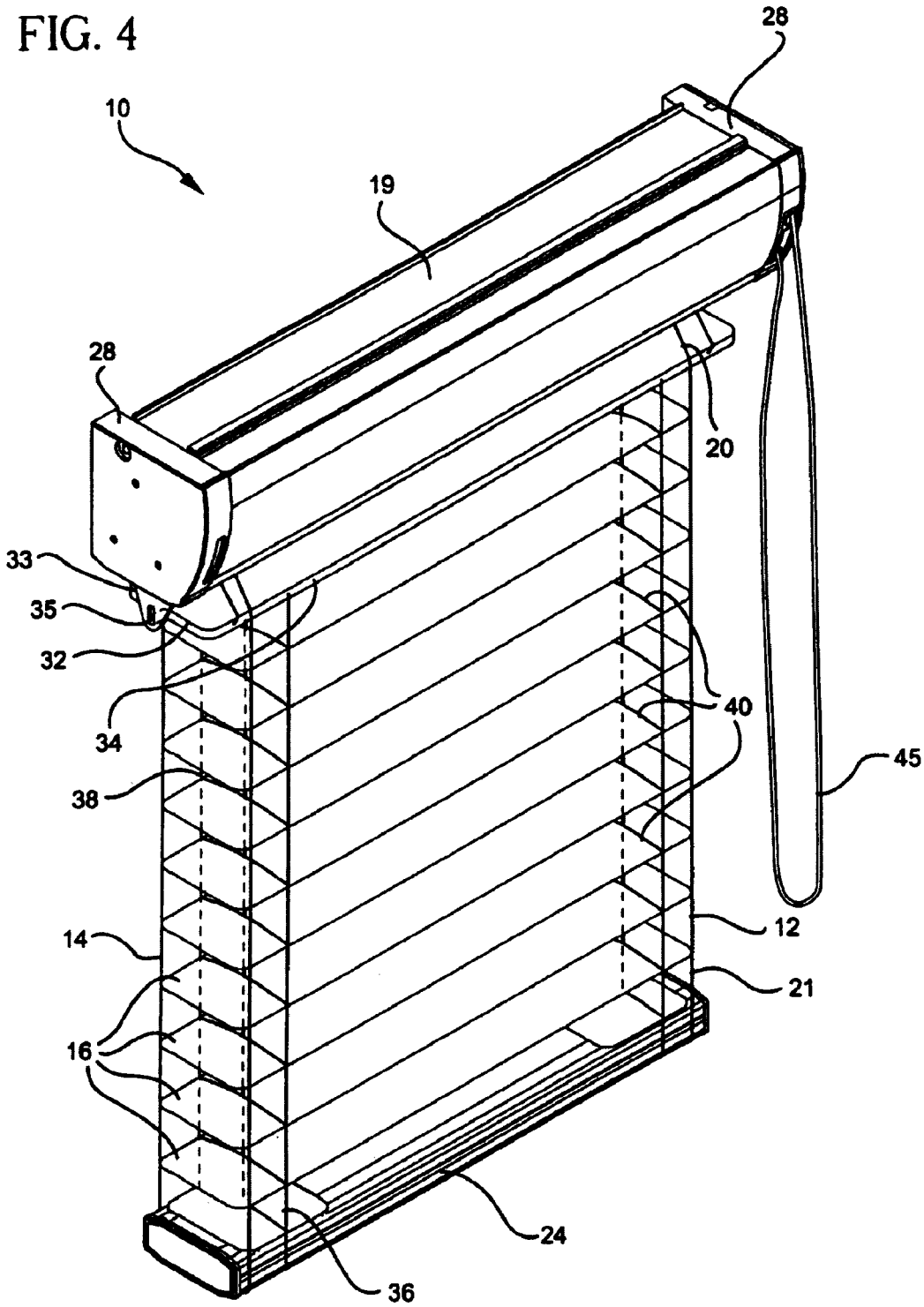
FIG. 4 is a disassembled perspective view showing the horizontal slats and guide cords according to one embodiment of the invention.

Before describing several exemplary embodiments of the invention, it is to be understood that the invention is not limited to the details of construction or process steps set forth in the following description. The invention is capable of other embodiments and of being practiced or carried out in various ways.

One or more embodiments of the present invention provides a window covering including a pair of sheets extending in a substantially vertical direction and a plurality of horizontal slats between the sheets of material. The plurality of horizontal slats is preferably in the form of a Venetian blind. As is known in the art, Venetian blinds typically comprise a plurality of horizontal slats suspended beneath a headrail by two or more flexible ladder laces. The ladder laces each include a pair of vertically extending side cords interconnected by a plurality of vertically spaced slat supporting rungs. The upper ends of the ladder side cords are typically attached to a ladder drum or tilt drum to tilt the slats in response to turning of the ladder drum. Carriers for the several ladders typically are rotated in unison by a tilt rod, tilt cords, or other mechanism known in the art.

Turning now to the drawings and particularly to FIGS. 1–4, a window covering according to one or more embodiments of the present invention is shown generally by reference numeral 10. The window covering 10 comprises two vertically extending sheets of material 12, 14. When the window covering is mounted in front of a window opening (not shown), sheet of material 12 is orientated to the front and sheet of material 14 is orientated to the rear. A plurality of horizontally extending slats or vanes 16 are disposed between the sheets of material 12, 14. A rotatable, substantially tube-shaped take-up member 18 is attached to an upper end 20 of the sheets of material 12, 14. The upper end 20 of the sheets of material 12, 14 can be affixed to the take-up member 18 by means of adhesive, rivets, eyelets or the like, or any other satisfactory mounting scheme, so long as the sheets of material can be wound on the take-up member without impediment.

In the embodiment shown in the Figures, the take-up member 18 is in the form of a tube configured to raise and lower the sheets of material by rolling the sheets of material 12, 14 onto the take-up member 18 as it is rotated, which will be described in more detail below. According to one or more embodiments, a tilt mechanism 22 is provided for tilting the slats 16 between open and closed positions, as will be described in more detail below. The tilt mechanism 22 is configured to tilt the slats when the window covering 10 is in any of a plurality of vertical positions. Thus, when the window covering 10 is completely lowered, the tilt mechanism 22 can be operated to tilt the slats 16 in an open position to admit varying amounts of light. The slats 16 can also be fully closed to fully block light from transmitting through the window covering. Advantageously, the window covering can be partially raised to any desired height by the user, and the slats 16 can be opened to any desired configuration, for example, fully open, partially open, or fully closed to admit or block varying amounts of light as desired.

According to one or more embodiments, the window covering 10 includes a horizontally extending bottom rail, with the sheets of material 12, 14 being attached to the bottom rail 24. The lower ends 21 of the sheets of material 12, 14 are affixed to the bottom rail by means of adhesive, rivets, eyelets or the like, or any other satisfactory mounting scheme. A cover slat or a decorative strip of material 26 may be mounted on the bottom portion of the bottom rail 24 to hide the rivets or eyelets and provide an aesthetically pleasing appearance.

According to certain preferred embodiments, the sheets of material 12, 14 are made from sheer material or material that is substantially transparent to light. In such embodiments, the two sheets of sheer material have different thread spacing are selected to prevent the moiré effect.

It will be appreciated that the take-up member will be mounted adjacent a window opening to a fixed surface using an appropriate mount. In the embodiment shown in FIG. 1, end brackets 28 are provided for this purpose. The end brackets 28 may have openings or slots for receiving pins 30 extending from end portions of the take-up member 18, or pins 29 extending from the intermediate rail. When the brackets 28 are mounted to fixed surface such as a wall or ceiling, the pins 30 extending from the end portions of the take-up member 18 are inserted into the openings or slots to support the take-up member 18 and the window covering 10 mounted thereto. As will be appreciated from the Figures, the sheets of material 12, 14 sandwich the horizontal slats 16, and a portion of the slats 16 are supported by the bottom rail 24 when the window covering is in a raised or partially raised position. In alterative embodiments, the mount for the take-up member 18 may include a horizontally extending head rail 19. The take-up member 18 may be mounted to the head rail 19 using bracket[s], end caps or any other conventional mounting scheme known in the art.

In one or more embodiments, the window covering 10 includes a horizontally extending intermediate rail 32 disposed between the bottom rail 24 and the take-up member 18. Preferably, the intermediate rail includes pins 35 extending from the ends thereof to facilitate mounting of the intermediate rail to a bracket mounted to a head rail 19 or to a fixed surface such as a wall or ceiling. The bracket will have holes or openings to accept the pins 35 extending from the intermediate rail.

Figure 5:
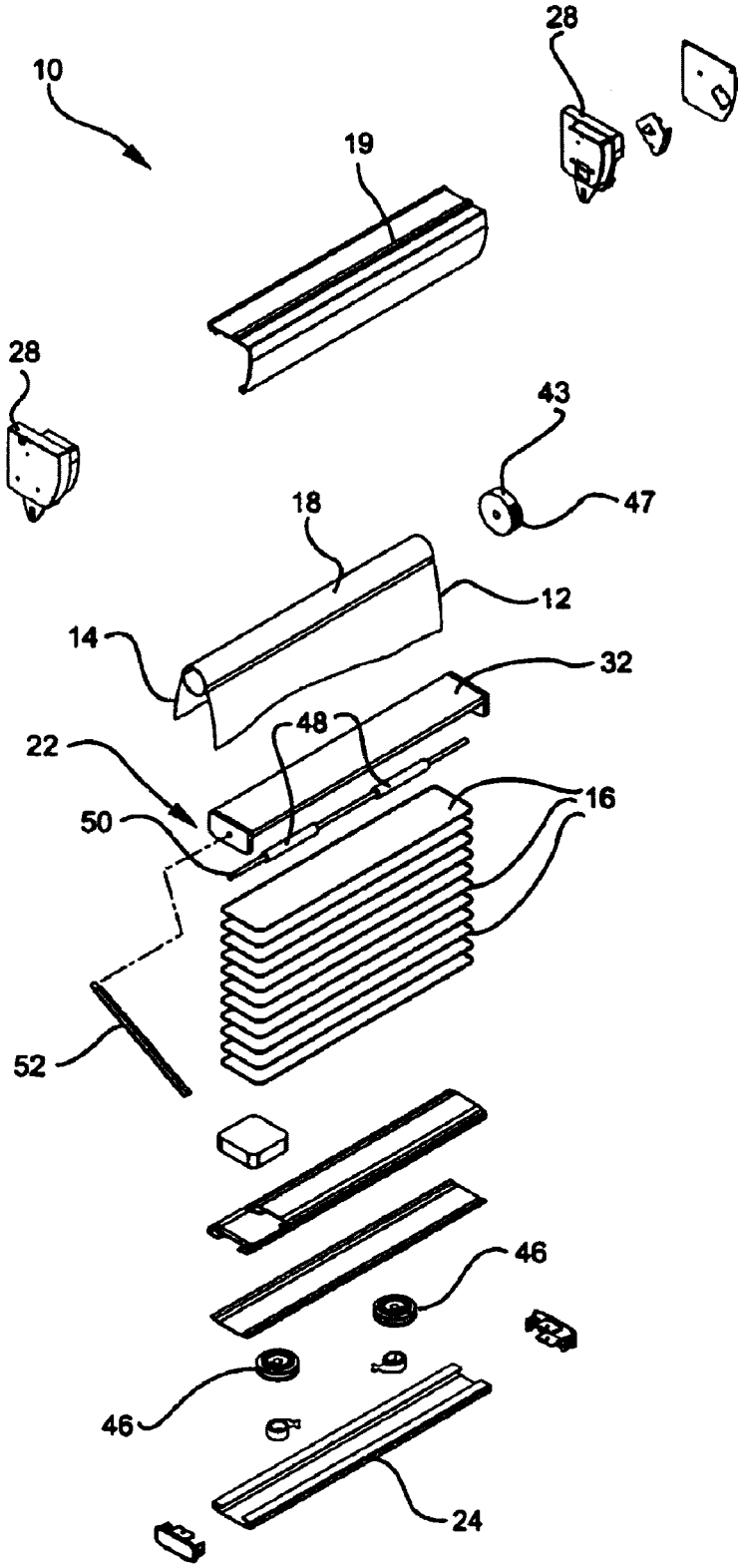
FIG. 5 is disassembled perspective view showing a window covering assembly having a separate tilting mechanism for the horizontal slats.
Figure 6:
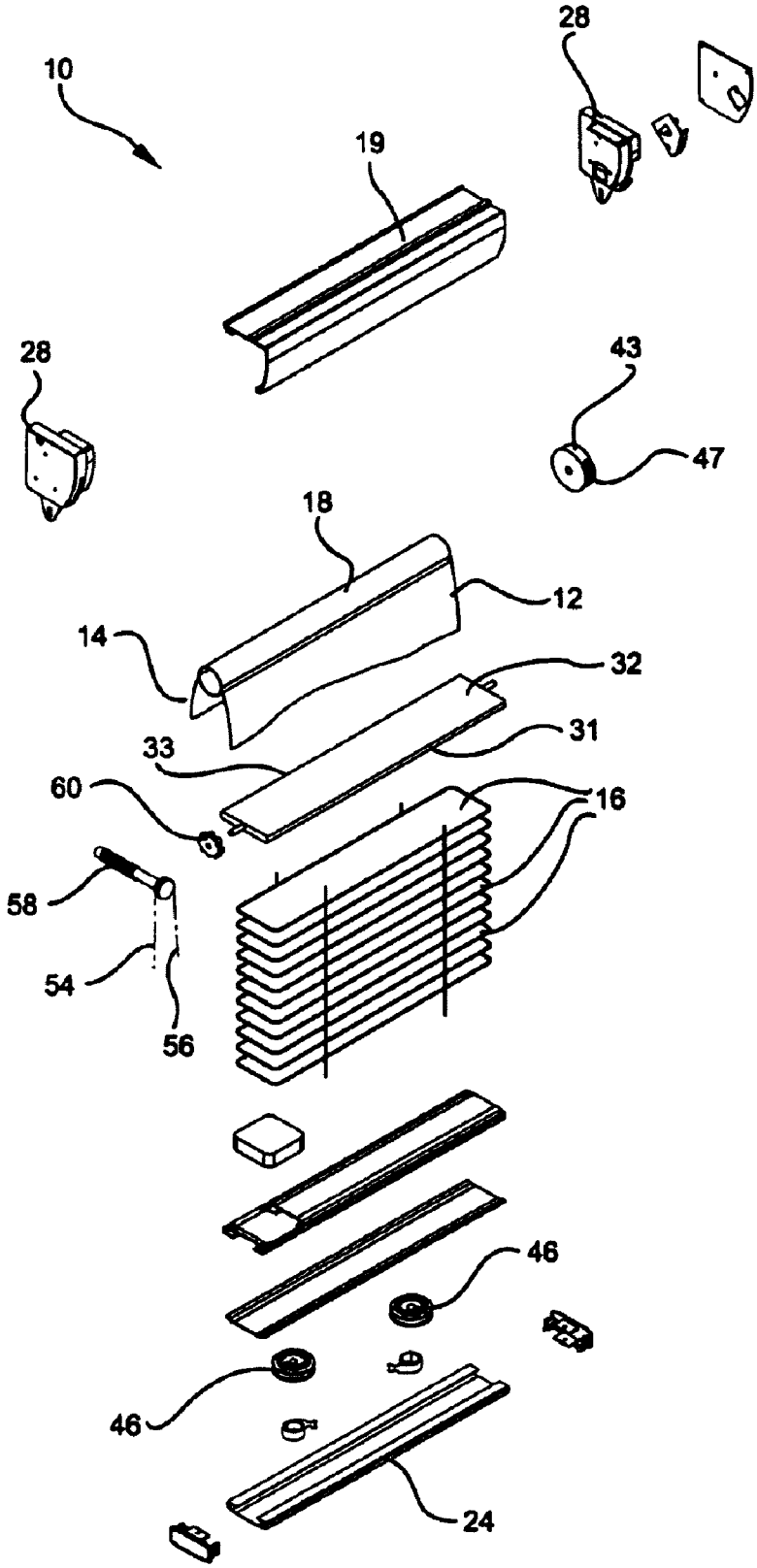
FIG. 6 is a disassembled perspective view showing an alternative slat tilting arrangement according to one embodiment.
Figure 7:
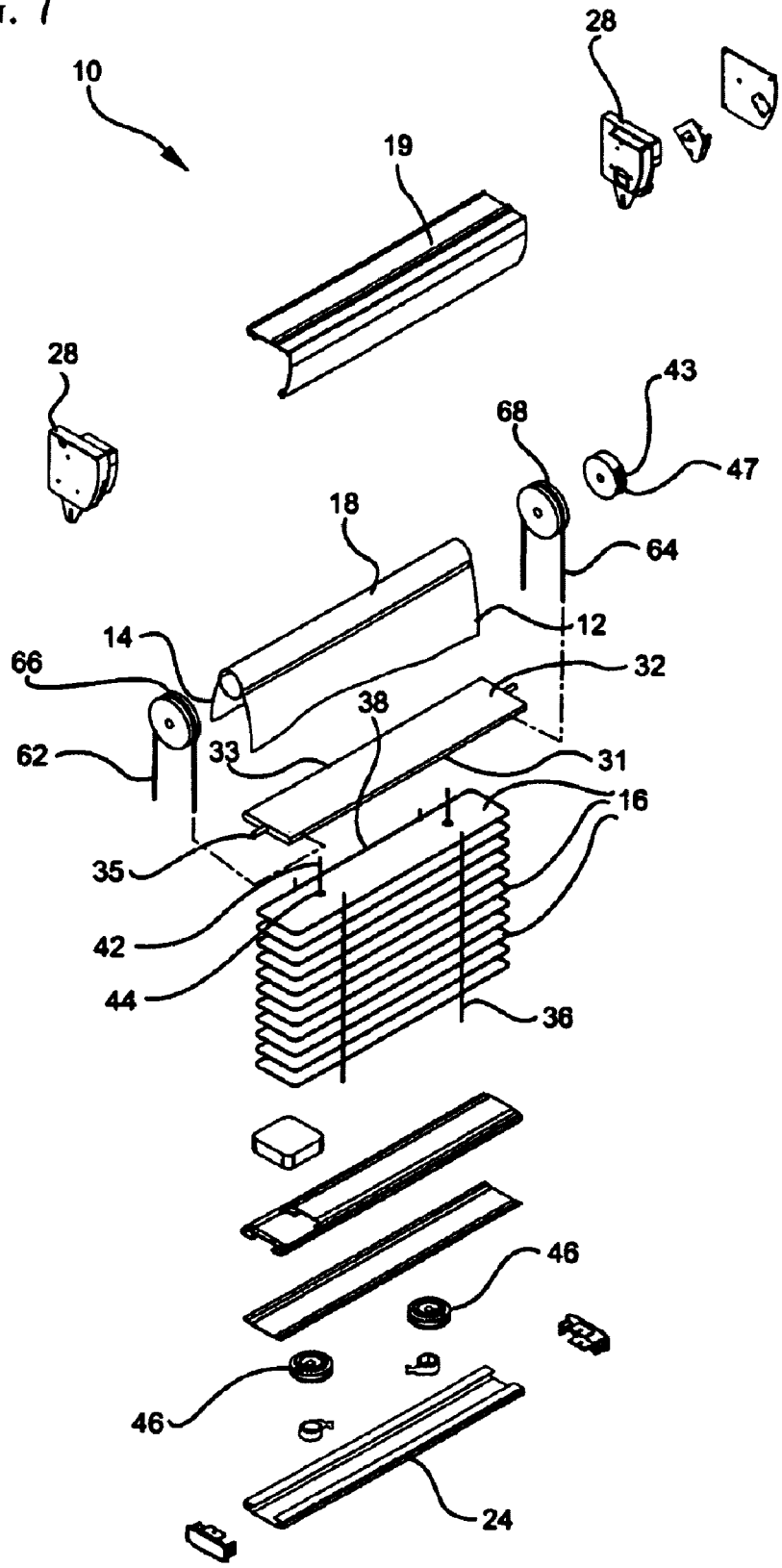
FIG. 7 is a disassembled perspective view showing another alternative slat tilting arrangement according to one embodiment.

With reference to FIGS. 5–7, the horizontal slats 16 are arranged in the form of a Venetian blind. Venetian blinds, which are known in the art, typically include a ladder lace 34 having two vertically oriented cords 36, 38 extending between the intermediate rail 32 and the bottom rail 24, and rungs 40 extending between the ladder cords 36, 38 to support slats of the blind. In the embodiments shown, ladder cord 36 faces the front of the window covering, and ladder cord 38 faces the rear of the window covering. To prevent the slats 16 from being laterally displaced from the rungs 40 of the ladder lace 34, a guide cord 42 is provided that runs in a substantially vertical direction between the intermediate rail 32 and the bottom rail 24 and through a hole or notch 44 in each of the slats 16. The holes or notches 44 for the guide cords 42 can be punched or drilled by equipment that is commonly available to fabricators and other manufacturers for use in making holes for lift cords employed in traditional Venetian blinds. Alternatively, the holes or notches 44 can be formed in the slat during the forming process for the slat. The embodiment shown in FIG. 4 does not include a guide cord 42, and the slats 16 are held in place by rungs 40 that wrap around each slat 16 to hold the slats in place. The rungs 40 may engage an indentation or small notch on the edges of the slats to hold the slats in place.

According to one or more embodiments including a guide cord 42, a cord take-up mechanism 46 associated with the window covering 10 is provided for taking up the guide cord. The cord take-up mechanism 46 may be associated with the head rail 19, however in preferred embodiments, the cord take-up mechanism 46 is associated with the bottom rail 24. Preferably, the take-up mechanism includes a spring motor mounted in the bottom rail. In preferred embodiments, the window covering 10 comprises a pair of guide cords 42 running in a substantially vertical direction between the intermediate rail 32 and the bottom rail 24 and through holes or notches 44 in each of the slats 16, and a pair of cord take up mechanisms 46 are associated with the bottom rail 24 for taking up each of the guide cords 42. It will be appreciated by those skilled in the art that in some instances, relatively small window coverings can be satisfactorily operated with only one or two guide cords. In larger window coverings, a greater number of guide cords may be needed. The selection of the appropriate number of guide cords and spring motors is a matter well known to those skilled in the art.

In one or more embodiments, the window covering 10 also includes a lift mechanism. As best shown in FIG. 1, the lift mechanism comprising a clutch mechanism 43 associated with the sheet take-up member 18 for rotating the take-up member 48 in a first direction to raise the sheets of material 12, 14 or in a second direction opposite from the first direction to lower the sheets of material 12, 14. Clutch mechanisms for roller shades are known in the art, and a skilled artisan will be able to select an appropriate clutch mechanism to raise the two sheets of material 12, 14 sandwiching the slats 16. The window covering 10 can be raised and lowered by means of conventional cords to drive the clutch mechanism 43. In preferred embodiments, the window covering 10 is raised and lowered with a continuous loop clutch 43 and a continuous loop cord 45 that engages the continuous loop clutch 43. To accommodate such cords, the clutch has a toothed surface 47 for engaging the cord 45. In preferred embodiments that utilize a continuous loop clutch, the continuous loop cord 45 is a beaded cord having a plurality of beads 49 secured to and spaced appropriately to engage the geared surface 47 and drive the clutch mechanism 43.

Clutches 43 are well known within the window covering industry. They serve to maintain the rotary position of a rotatable take-up member such as 18, unless and until the user operates the clutch by means of pulling on the cord loop 45 in one direction or other. In various embodiments of the present invention, pulling on the cord loops 45 in one direction causes rotation of the take-up member 18 to lift the sheets of material 14, the bottom rail 24 to which they are attached and the slats 16 sandwiched by the sheets of material 12, 14 and supported by the bottom rail by a desired amount. The window covering 10 can be lowered by a distance desired by a user by pulling the continuous loop cord 45 in the opposite direction, which causes rotation of the take-up member such that the shade is lowered by a desired amount. When the cord is not operated, the take-up member 18 holds its position. Examples of such clutches are illustrated in, for example, U.S. Pat. Nos. 4,372,432 and 4,433,765, each of which is incorporated herein by reference. It has been found that the clutch sold by ROLLEASE having Model No. RC3 operates effectively in this environment.

As discussed above, the window covering according to certain preferred embodiments includes a tilt mechanism for tilting the slats between open and closed positions. Referring specifically to FIG. 5 and according to one or more embodiments, the tilt mechanism 22 includes one or more tilt drums 48 associated with the intermediate rail and an axially extending tilt shaft 50 in communication with the tilt drum 48. The tilt shaft 50 is configured such that rotation of shaft 50 rotates the drum 48, causing one of the ladder cords 36, 38 to be raised from a neutral position and the other ladder cord 36, 38 to be lowered from a neutral position. In the embodiment shown in FIG. 5, the ladder cords 36, 38 are fastened to the tilt drums 48, which are mounted to axially extending tilt shaft 50. A tilt wand 52 is in communication with the tilt shaft 50 so that rotation of the tilt wand 52 causes rotation of the axially extending tilt shaft 50, in turn causing the tilt drums 48 to rotate and move one of the ladder cords upwardly and the other of the ladder cords to be moved downwardly. Such movement of the ladder cords 36, 38 causes the rungs 40 and the slats 16 supported by the rungs 40 to tilt. A gear mechanism such as a worm gear (not shown), which is known in the art, can be used to cause rotation of the tilt shaft 50 to rotate the tilt shaft 50. It will be appreciated that devices other than a tilt wand 52 can be used to drive the worm gear. For example, a pull tilt cord or pair of pull tilt cords, which will be described below with respect to the embodiment shown in FIG. 6 can be used to drive the worm gear, which in turn drives the tilt shaft and the tilt drum to tilt the slats.

FIG. 6 shows an alternative arrangement for tilting the slats. Instead of a tilt wand 52, pull tilt cord 54, 56 are provided that interacts with a gear mechanism 58 to cause rotation of a gear 60 mounted on the intermediate rail 32, which in turn causes rotation of the intermediate rail 32. The pull tilt cords 54, 56 are mounted to the head rail 19 or mounting brackets 18. In the embodiment shown in FIG. 5, the ladder cords 36, 38, are mounted to the intermediate rail at a front portion 31 and a rear portion 33 of the intermediate rail 32. Pulling one of the pull tilt cords 54 or 56 causes rotation of the gear 60 mounted to the intermediate rail 32, causes the intermediate rail 32 to rotate, causing one of the ladder cords 36 or 38 to be lowered, and the other of the ladder cords 36 or 38 to be raised. This movement causes the rungs 40 of the ladder lace 34 to tilt, which in turn causes the slats 16 supported by the rungs 40 to tilt. Pulling the other of the pull tilt cords 54 or 56 causes the slats 16 to tilt in the opposite direction. It will be appreciated that a tilt wand similar to the wand shown in FIG. 5 can be used to drive the worm gear 58 to effect movement of the slats 16.

Figure 8:
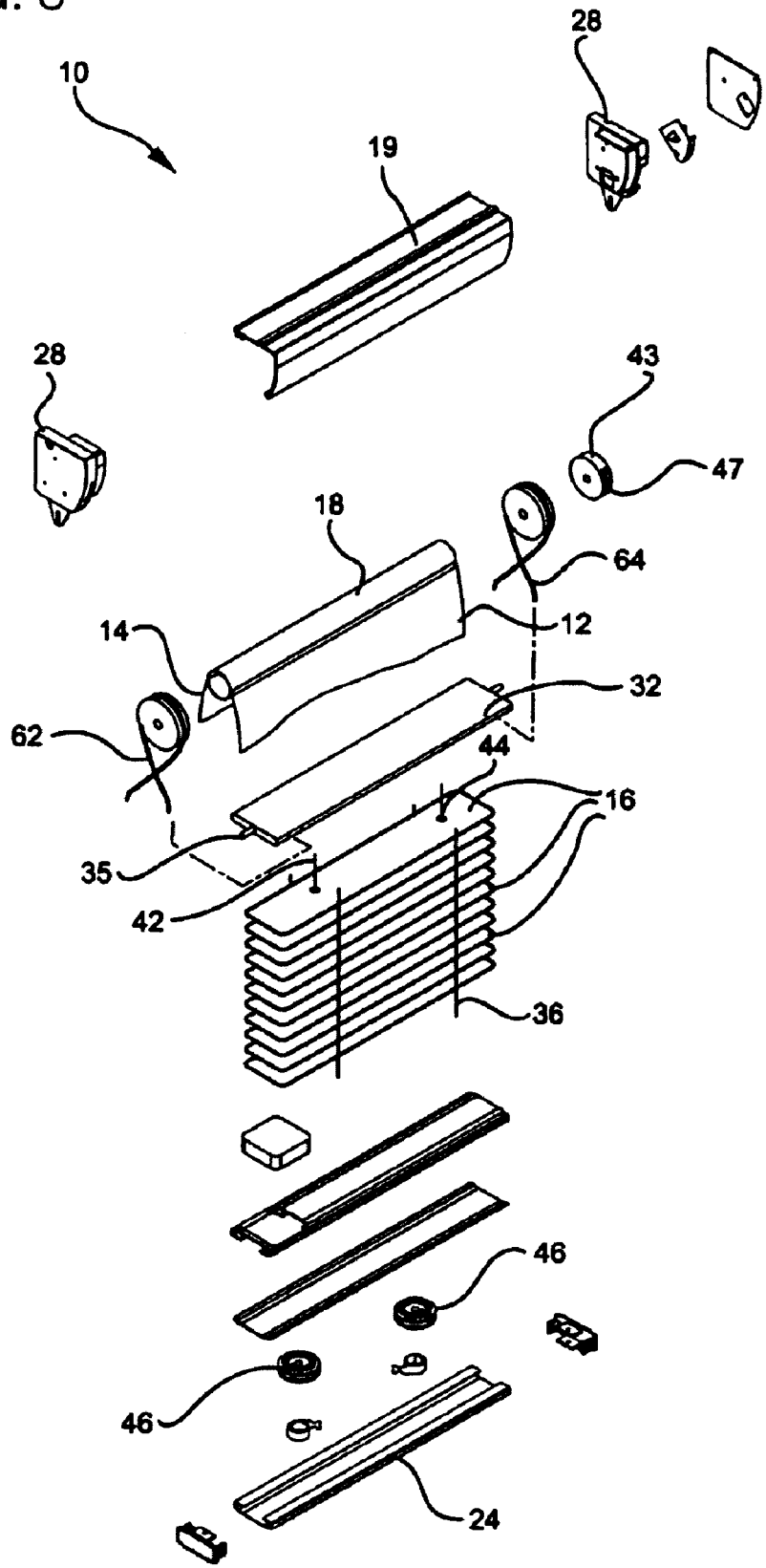
FIG. 8 is a disassembled perspective view showing still another alternative slat tilting arrangement according to one embodiment.

Additional alternative schemes for tilting the slats are shown in FIGS. 7 and 8. In the embodiments shown in FIGS. 7 and 8, the tilt mechanism comprises a tilt cord 62 and preferably a pair of tilt cords 62, 64 attached to a front portion 31 and a rear portion 33 of the intermediate rail 32 and straddling an upper portion 17 of the take-up member 18, which, in the embodiment shown, is in the form of a tube. In the embodiment shown in FIG. 7, the pair of tilt cords 62, 64 straddle the take-up member. In FIG. 8, each of the tilt cords 62, 64 is configured so that the cords cross over each other to form an "X" when they are fastened between the take-up member 18 and the intermediate rail 32.

In preferred embodiments, a slot or groove 66, 68 is provided for frictionally engaging the tilt cords 62, 64 with the take-up member 18. Thus, the tilt cords 62, 64 are placed in their respective slots 66, 68. The take-up member 18 is rotated by means of a clutch or spring-driven winding mechanism or spring motor (not shown), and the tilt cords 62, 64 are operative to tilt the slats 16 in a first direction when the sheets of material 12, 14 are raised and wrapped around the take-up member. When the sheets of material 12, 14 are lowered unwrapped from around the take-up member, the slats 16 are tilted in a second direction opposite to the first direction.

Figure 9:
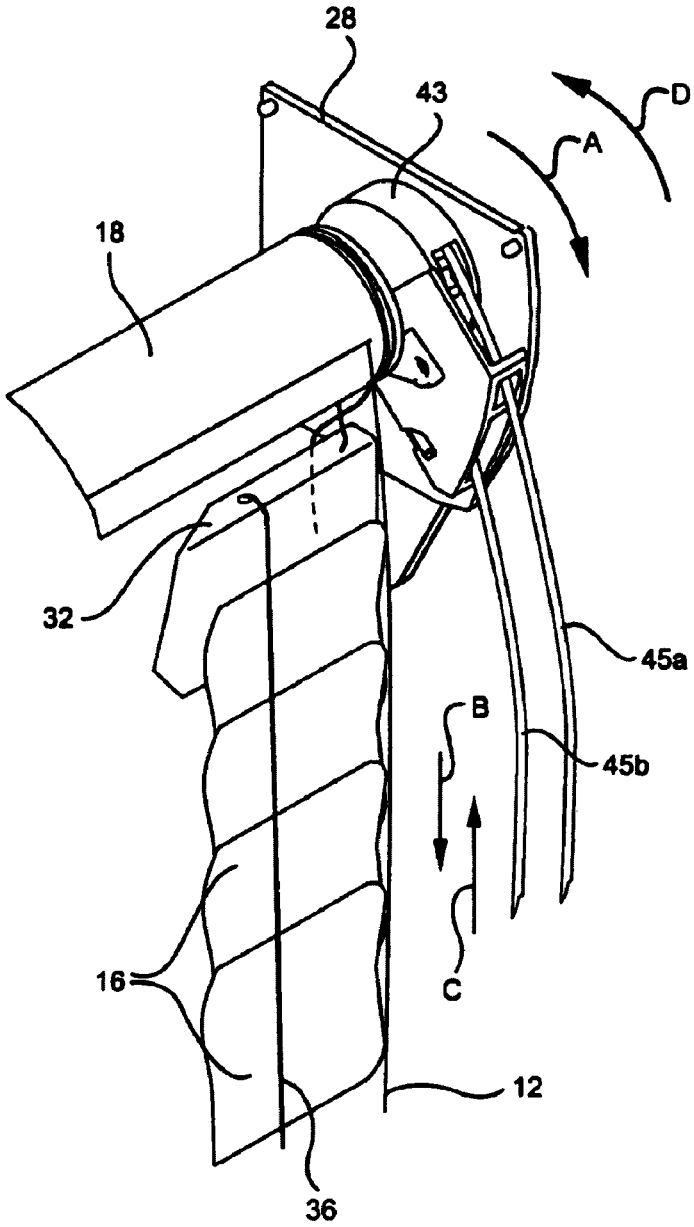
FIG. 9 is a partial perspective view showing operation of the tilt mechanism shown in FIG. 7 when the horizontal slats are in a rearward closed position.
Figure 10:
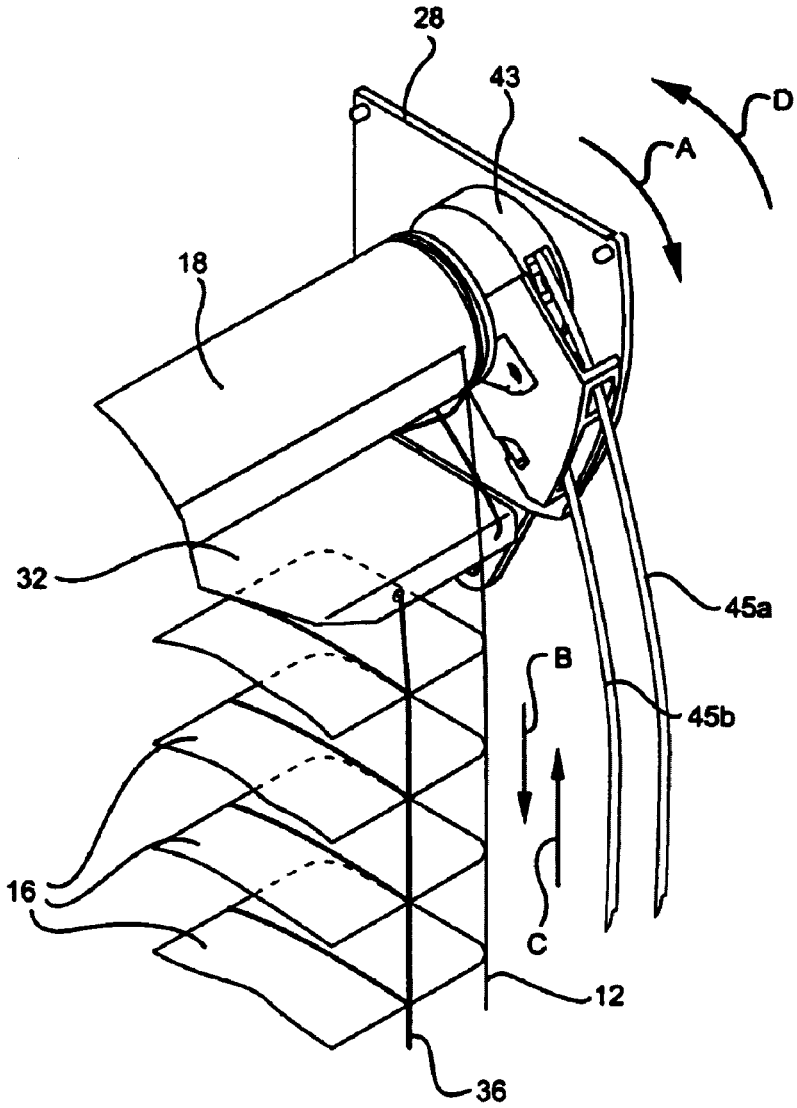
FIG. 10 is a partial perspective view showing operation of the tilt mechanism shown in FIG. 7 when the horizontal slats are in an open position.

Operation of the slat tilting mechanism will now be described in more detail. The sheets of material 12, 14, the guide cords 42 and other features are omitted to provide a clear view of tilting of the slats 16. As will be understood by the description below, fastening the of the ladder lace cords 36, 38 to the front portion 31 and rear portion 33 of the intermediate rail 32 enables slats 16 to be rotated between a first closed position and a second closed position. When the window covering 10 is lowered by rotating the take-up member 18 in a direction indicated by an arrow designated "A" by pulling cord 45*a* in direction "B," the intermediate rail 32 and the slats 16 preferably rotate from a first or rearwardly closed to an open position as shown in FIGS. 9 and 10. Simultaneously with rotation of the take-up member 18, the front ladder cord 36 is actuated by rotation of the intermediate rail 32 so that the front ladder cord moves in the direction indicated by arrow "B" and rear ladder cord 38 moves in the direction indicated by arrow "C." To close the blinds to a first closed position again, this process is reversed, and cord 45*b* is pulled in the direction "B", causing ladder cord 36 to move in the direction "C" and rear cord to move in the direction "B". Once the slats 16 are moved to back a first closed position and they cannot move any further from the first closed position, further rotation of take-up member 18 will result in slippage between the slot or grooves 66, 68 and their respective tilt cords 62, 64 attached to the intermediate rail, whereby the slats 16 remain in the first closed position. The slats 16 will continue to remain in the first closed position until the take-up member 18 is raised so that the bottom rail 24 is once again lifted toward the head rail 19.

Figure 11:
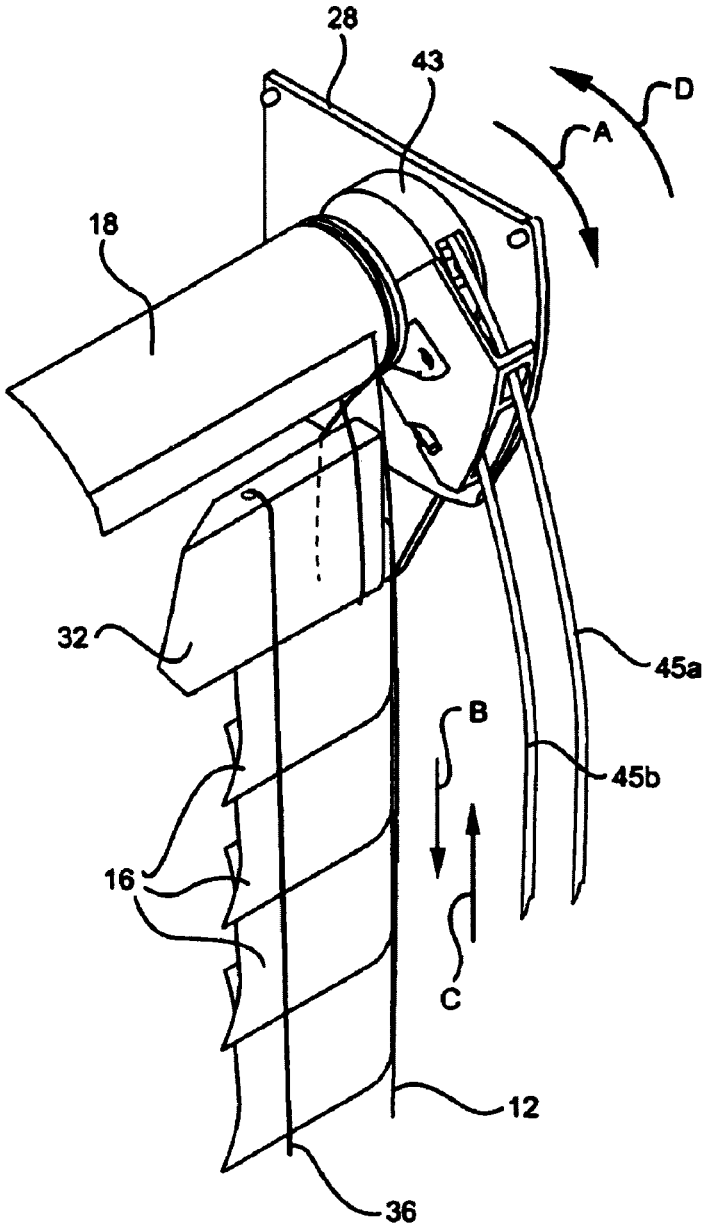
FIG. 11 is a partial perspective view showing the operation of the tilt mechanism shown in FIG. 7 when the horizontal slats are in a forward closed position.

To move the slats 16 from a first closed position as shown in FIG. 9 to a second or forward closed position shown in FIG. 11, the take-up member 18 is rotated in the direction indicated by arrow "D" by pulling the cord 45*a* in direction "B". This causes rotation of the slots or grooves 66, 68 on the take-up member 18 and movement of the respective tilt cords 62, 64. Rotation of the intermediate rail 32 attached to the ladder cords 36, 38 will cause the front ladder cord 36 to move in the direction indicated by arrow "B" and the rear ladder cord 38 to move in the direction "C", causing slats 16 to rotate approximately 150 to 180 degrees between the first closed position and a second closed position as shown in FIGS. 10 and 11. Once the slats 16 are rotated to the second closed position, further rotation of take-up member 18 will result in slippage between the slots or grooves 66, 68 and their respective tilt cords 62, 64 and the slats 16 remain in the second closed position. Reversing the direction of rotation of the take-up member to lower the window covering 10 will again rotate intermediate rail 32, moving the tilt cords 36, 38 to rotate the slats 16 between about 150 and 180 degrees from the second closed position to the first closed position.

According to one or more embodiments of the present invention, the horizontal slats 16 and sheets of material 12, 14 are not directly connected. Instead, and as described above, the sheets of material are connected to the take up member 18 and the bottom rail 24, such that the sheets of material are vertically orientated and substantially parallel with a space therebetween to hold the horizontal slats 16. The sheets of material 12, 14 attached to the bottom rail 24 form a support structure for supporting a portion of the slats 16 as the window covering is raised and lowered.

When the window covering 10 is mounted and ready for operation, it is possible to adjust the slats 16 when the window covering is in a variety of vertical positions, as the user sees fit. In addition, according to one or more embodiments, the slats 16 can be adjusted independently from the raising and lowering of the blinds. Advantageously, if the window covering is partially raised or partially lowered, a user can admit varying amounts of light by adjusting the tilt of the slats between first and second closed positions. Thus, it is possible for a user to adjust the window covering to a desired height using the lift mechanism associated with the take-up member for the sheets of material. After the window covering has been raised or lowered to a desired height, the user can fully block light by closing the slats or admit light by opening the slats as described above.

Although the invention herein has been described with reference to particular embodiments, it is to be understood that these embodiments are merely illustrative of the principles and applications of the present invention. For example, while in certain embodiments, tilting of the slats was accomplished by attaching the ladder cords to a tilt drum or an intermediate rail, tilting of the slats may also be accomplished by fastening the ladder cords to the take up member. In addition, while certain Figures and embodiments described raising the window covering by using a clutch lifting mechanism, a conventional roller shade lifting mechanism employing a spring motor may also be used for the purpose of raising and lowering the window covering. It is therefore to be understood that numerous modifications may be made to the illustrative embodiments and that other arrangements may be devised without departing from the spirit and scope of the present invention as defined by the appended claims and their equivalents.

What is claimed is:

1. A window covering comprising:

two vertically extending sheets of material having a plurality of horizontally extending and vertically spaced slats disposed therebetween;

a rotatable, substantially tube-shaped take-up member attached to one end of the sheets of material, the take-up member configured to raise and lower the sheets of material;

a tilt mechanism for the horizontal slats, the tilt mechanism configured to tilt the slats when the window covering is in all vertical positions; and a horizontally extending bottom rail, wherein the sheets of material are attached to the bottom rail.

2. The window covering of claim 1, wherein the sheets of material include sheer material.

3. The window covering of claim 2, wherein the two sheets of material are configured to prevent a moiré effect.

4. The window covering of claim 1, further comprising a mount configured to secure the take-up member adjacent a window opening.

5. The window covering of claim 4, wherein the mount includes a pair of brackets configured to connect to end portions of the take-up member.

6. The window covering of claim 5, further including a horizontally extending intermediate rail disposed between the bottom rail and the take-up member.

7. The window covering of claim 4, wherein the mount comprises a horizontally extending headrail.

8. The window covering of claim 7, further including a horizontally extending intermediate rail disposed between the bottom rail and the take-up member.

9. The window covering of claim 4, further comprising a horizontally extending intermediate rail disposed between the bottom rail and the take-up member.

10. The window covering of claim 9, further comprising a ladder including two vertically oriented ladder cords extending between the intermediate rail and the bottom rail, and rungs extending between said ladder cords to support slats of the blind.

11. The window covering of claim 10, further comprising a guide cord running in a substantially vertical direction between the intermediate rail and the bottom rail and through a hole or notch in each of the slats.

12. The window covering of claim 11, further comprising a cord take-up mechanism associated with the window covering for taking up the guide cord.

13. The window covering of claim 12, wherein the cord take-up mechanism is associated with the bottom rail.

14. The window covering of claim 13, wherein the cord take-up mechanism comprises a spring motor.

15. The window covering of claim 10, further comprising a pair of guide cords running in a substantially vertical direction between the intermediate rail and the bottom rail and through holes or notches in each of the slats, and a pair of cord take up mechanisms associated with the bottom rail for taking up each of the guide cords.

16. The window covering of claim 15, wherein the cord take up mechanisms include a spring motor.

17. The window covering of claim 10, further comprising a tilt mechanism for the slats.

18. The window covering of claim 17, wherein the tilt mechanism includes a tilt drum associated with the intermediate rail and an axially extending tilt shaft in communication with the tilt drum, the tilt shaft configured such that rotation of shaft rotates the drum, causing one of the ladder cords to be raised and the other ladder cord to be lowered from a neutral position.

19. The window covering of claim 17, wherein the tilt mechanism comprises a tilt cord attached to a front portion and a rear portion of the intermediate rail and straddling an upper portion of the take-up member.

20. The window covering of claim 19 wherein the tilt cords cross over each other between the take up member and the intermediate rail.

21. The window covering of claim 20, wherein the tilt cord is operative to tilt the slats in a first direction when the sheets of material are raised and wrapped around the take-up member and tilt the slats in a second direction opposite to the first direction when the sheets of material are lowered and unwrapped from around the take-up member.

22. The window covering of claim 21, further comprising a slot on the take up member for frictionally engaging the tilt cord on the take-up member.

23. The window covering of claim 17, further comprising a clutch mechanism associated with the take-up member for rotating the take-up member to raise or lower the sheets of material.

24. The window covering of claim 23, wherein raising and lowering the sheets of material also raises and lowers at least a portion of the horizontal slats.

25. A window covering comprising:

two vertically extending sheets of material having a plurality of horizontally extending and vertically spaced slats disposed therebetween;

a rotatable, substantially tube-shaped take-up member attached to one end of the sheets of material, the take-up member configured to raise and lower the sheets of material;

a bottom rail attached to end of the sheets of material opposite the end attached to the take-up member, wherein the horizontally extending slats can be tilted independently of the sheets of material.

26. The window covering of claim 25, wherein the horizontal slats and sheets of material are not directly connected.

27. The window covering of claim 26, wherein the sheets of material are sheer material.

28. The window covering of claim 25, further comprising a guide cord associated with the slats and extending between the take-up member and the bottom rail.

29. The window covering of claim 28, further comprising cord take-up means for taking up the guide cord when the window covering is raised.

30. The window covering of claim 29, wherein the cord take-up means includes a spring motor.

31. A window covering comprising:

two sheets of material suspended from a take-up roller and attached to a horizontally extending bottom rail, the sheets of material having a space therebetween;

a horizontally extending intermediate rail located between the take-up roller and the bottom rail;

a plurality of horizontal slats disposed between the sheets of material having a guide cord running through an opening or slot in each of the slats and a ladder lace including a pair of vertically extending ladder lace cords having rungs extending between the ladder lace cords configured to support the slats;

means for rotating the take-up roller such that the sheets of material wrapped around the take-up roller are raised to an elevated position;

means for adjusting the slats between an open and closed position; and means for taking up the guide cords.

32. The window covering of claim 31, wherein the means for rotating the take-up roller includes a clutch mechanism.

33. The window covering of claim 31, wherein the means for rotating the take-up roller further includes a pull cord.

34. The window covering of claim 33, wherein the pull cord is a beaded pull cord for engaging a gear surface associated with the means for rotating the take-up roller.

35. The window covering of claim 31, wherein the means for adjusting the slats includes a rotation cord attached to a front portion and a rear portion of the intermediate rail.

36. The window covering of claim 35, wherein the rotation cord is in frictional contact with the take-up roller.

37. The window covering of claim 36, wherein rotation of the take-up roller causes the rotation cord to tilt the slats to a closed position.

38. The window covering of claim 34, wherein the means for taking up the guide cord is associated with a headrail.

39. The window covering of claim 34, wherein the means for taking up the guide cord is associated with the bottom rail.

40. The window covering of claim 39, wherein the means for taking up the guide cord includes a spring motor.

41. The window covering of claim 40, wherein a pair of guide cords is provided and a pair of spring motors associated with the bottom rail are provided for winding the guide cords as the window covering is raised.

42. A method of operating a window covering comprising:

rolling a pair of sheets of vertically extending and substantially parallel sheets onto a take up member to a plurality of desired heights to raise or lower a horizontally extending bottom rail attached to the sheets of material; and adjusting the tilt angle of a plurality of horizontally extending slats disposed between the sheets of material in all of the plurality of desired heights.

43. The method of claim 42, wherein the tilt angle of the slats is adjusted independently from the adjustment of the height of the sheets of material.

44. The method of claim 43, wherein the sheets of material are sheets of sheer material selected to prevent a moiré effect.

45. The method of claim 42, wherein the slats form a Venetian blind including a guide cord extending through openings in each of the slats, and further comprising taking up slack in the guide cord as the sheets of material are raised.

46. The method of claim 45, wherein the sheets of material are joined at their lower end to a bottom rail, and the bottom rail includes a spring motor mechanism for taking up the guide cord.

* * * * *